US006186589B1

(12) United States Patent
Burkamp

(10) Patent No.: US 6,186,589 B1
(45) Date of Patent: Feb. 13, 2001

(54) PORTABLE, CHILDREN'S ALL-PURPOSE DESK

(76) Inventor: Johann Burkamp, 603 Lee Rd., Havelock, NC (US) 28532

( * ) Notice: Under 35 U.S.C. 154(b), the term of this patent shall be extended for 0 days.

(21) Appl. No.: 09/412,421

(22) Filed: Oct. 5, 1999

(51) Int. Cl.[7] ..... A47B 39/00
(52) U.S. Cl. ..... 297/142; 297/170; 297/173
(58) Field of Search ..... 297/141, 142, 297/170, 173, 135, 139, 140, 143

(56) References Cited

U.S. PATENT DOCUMENTS 1,182,339 * 5/1916 Bekesi ..... 297/142
2,625,206 * 1/1953 Abbate et al. ..... 297/170 X
4,617,869 * 10/1986 Demoney ..... 297/142 X
5,820,208 * 10/1998 Miklinevich ..... 297/170 X
5,967,600 * 10/1999 Jelacic et al. ..... 297/142
6,010,186 * 1/2000 Tsay ..... 297/173 X

* cited by examiner

*Primary Examiner*—Peter R. Brown
(74) *Attorney, Agent, or Firm*—Susan E. Nagel, Esq.

(57) ABSTRACT

The invention is a collapsible and thereby portable children's desk with a reversible top board including a blackboard on one side. The invention includes a two-legged support frame for a reversible, slanted board which may be stored in between the two-legged support frame; a storage tray for writing utensils also supported between the two-legged support frame; a double-layered side arm connecting one side of the support frame to a child's seat; and the necessary hinges to allow the desk to be collapsed with a 3 step process including: first, the folding of the chair to be flush with the side arm and then the placement of the chair and side arm within the two-legged support frame and finally the lifting up and sliding down of the board between the two-legged support frame.

3 Claims, 3 Drawing Sheets

PORTABLE, CHILDREN'S ALL-PURPOSE DESK

BACKGROUND

1) Field of the Invention

The field of the invention relates to children's play and educational devices, in particular to children's desks which have both a play and an educational purpose and which are readily portable due to the fold-up nature of the invention.

2) Description of the Related Art

Tables with boards for children's play tables and chalkboards exist in the prior art; portable art and board-like devices also exist. This invention includes each of these aspects to provide a portable art and work table for children which can be stored in a small area.

SUMMARY OF INVENTION

The invention is a collapsible and thereby portable children's desk with a reversible top board including a blackboard on one side. The invention includes a two-legged support frame for a reversible, slanted board which may be stored in between the two-legged support frame; a storage tray for writing utensils also supported between the two-legged support frame; a double-layered side arm connecting one side of the support frame to a child's seat. The invention is portable by virtue of a three step process including: first, the folding of the chair to be flush with the side arm and then the placement of the chair and side arm within the two-legged support frame and finally the lifting up and sliding down of the board between the two-legged support frame.

DESCRIPTION OF PREFERRED EMBODIMENT

Figure 1:
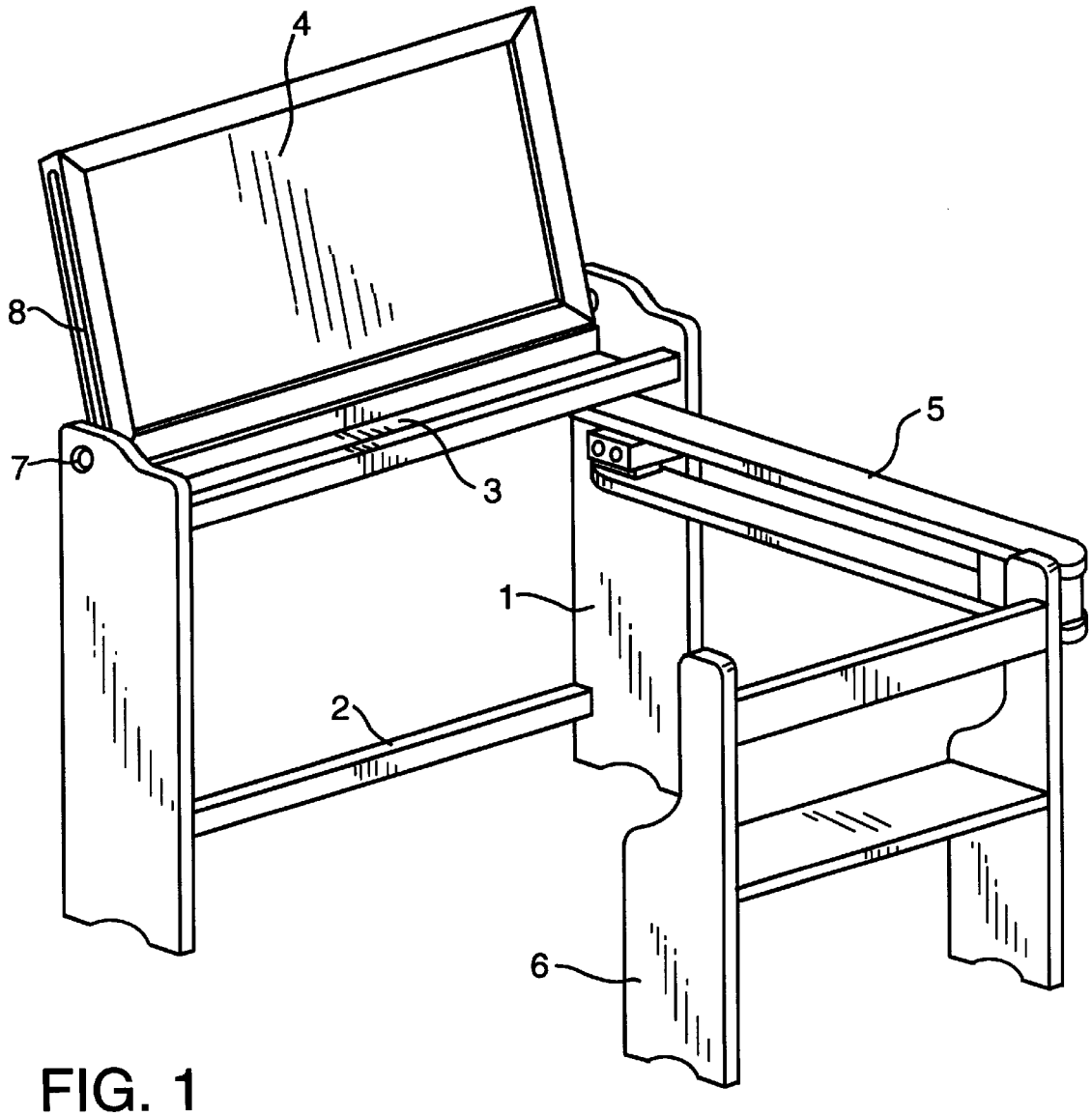
FIG. 1 is a perspective view of the invention in its fold-out state, with the blackboard side of the board shown.
Figure 2:
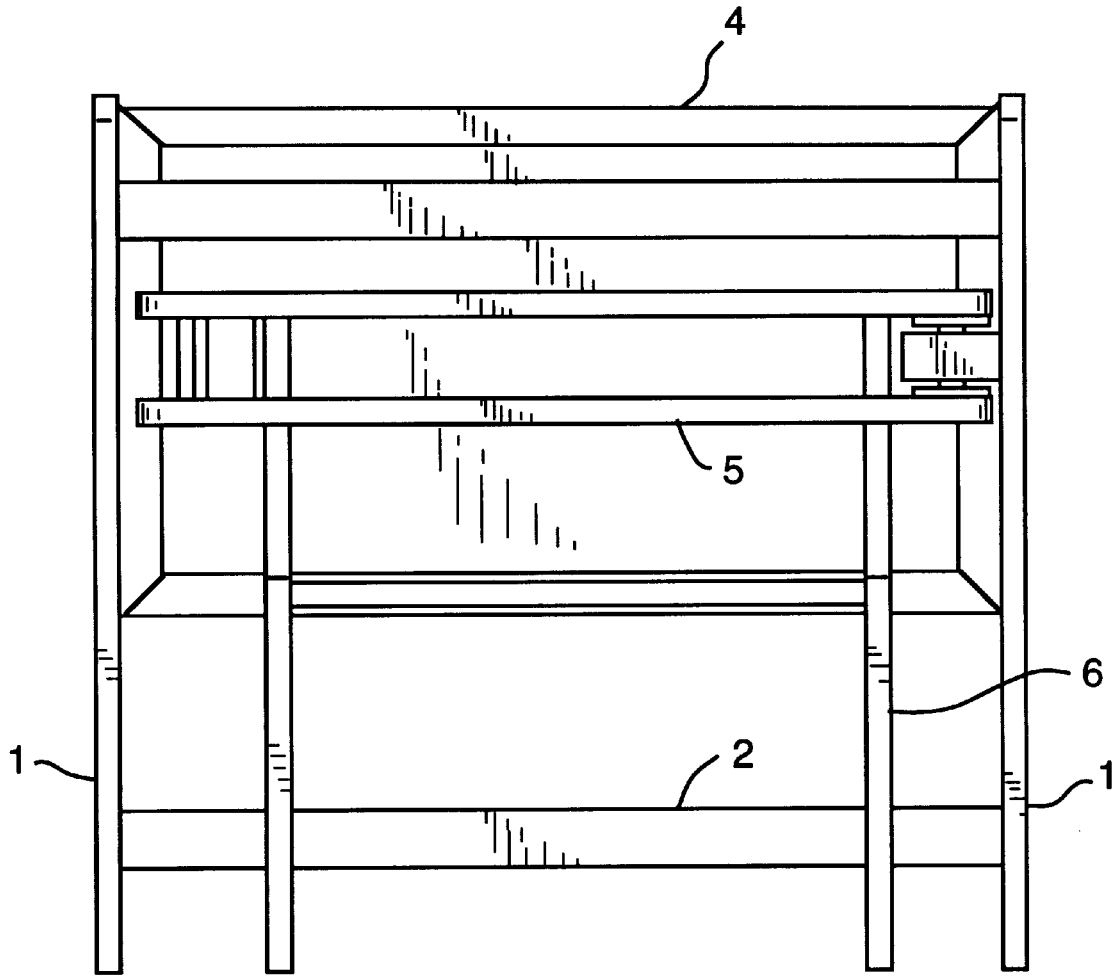
FIG. 2 is a frontal view of the invention in its collapsed, portable state.

As can be viewed in FIG. 1, the invention is comprised of two vertical standing support legs (1) connected by a bar (2). The support legs (1) support between them a tray (3) and are attached at each of their uppermost aspects, to a board (4). The joint (7) between the board (4) and support legs (1) is located above and behind the connection between the tray (3) and support legs allowing the board to slant downwardly and rest upon toward tray (3) Also attached to one of the two support legs is a double layered side arm (5) connecting one support leg (1) to a chair (6). As can be viewed in FIG. 2, the invention may be fully collapsed and is portable. This is done by folding chair (6) flush to side arm (5), then folding this combination to be housed within the two support legs (1) and finally to lifting board (4) up and then sliding it down between support legs (1).

Figure 3:
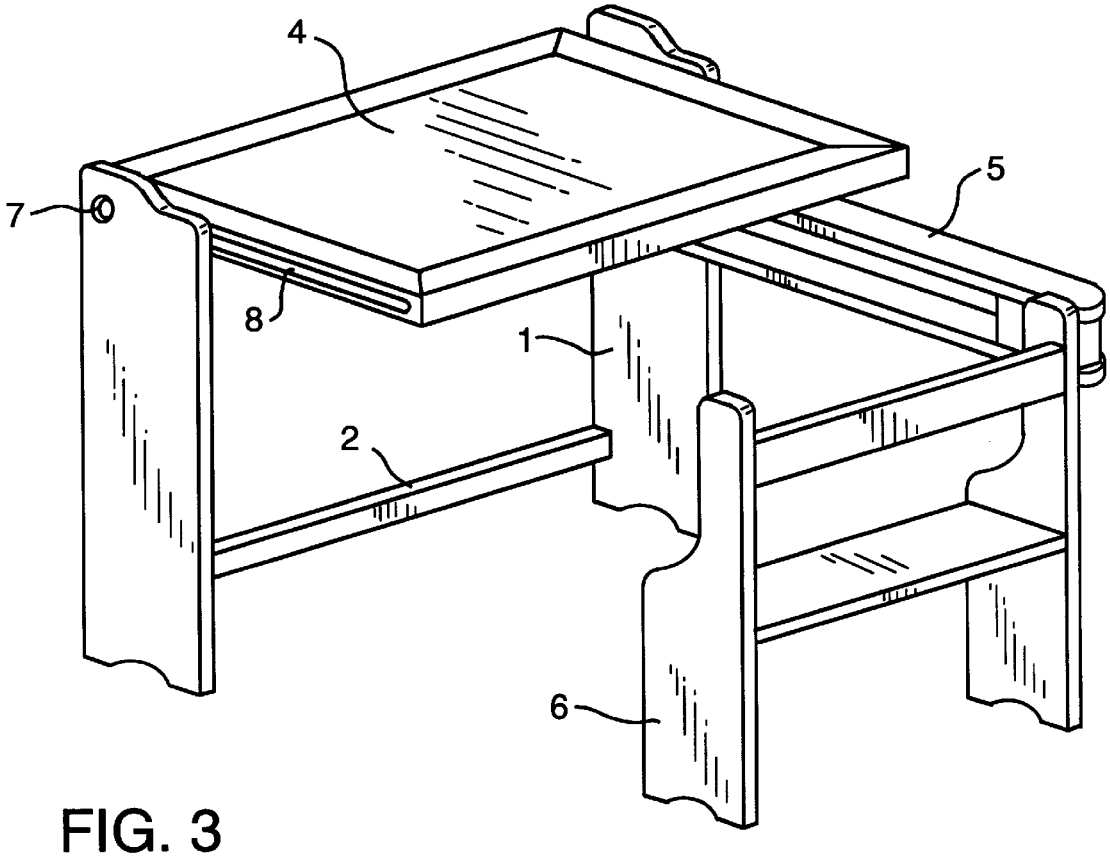
FIG. 3 is a perspective view of the support frame with the board lifted up to illustrate the side tract allowing it to be stored within the frame and the storage tray located between the support legs.

As can be viewed in FIG. 3, the joint (7) between board (4) and support legs (1) is comprised of a tract (8) in board which accepts the long end of bolt at joint (7) and which allows the two sides of board (4) to be freely reversed. This occurs by sliding the bolt along the tract (8) until either end of the tract is reached, and then either resting the board (4) down on try or lifting board (4) and resting the other side of board (4) down.

What is claimed is:

1. A portable, children's all-purpose desk which is comprised of two support legs (1) connected by a tray (3); a top board (4) capable of being reversed from one side to other, having a connecting circular joint (7) with said legs (1) at a top of said legs (1), said joint (7), allowing said board (4) to be pivoted from one side to another, wherein said joint (7) between said legs (1) and said board (4) comprises a tract (8) along both sides of said board (4) and a bolt protruding from said joint (7), said joint (7) allowing the board (4) to be reversed by sliding said bolt to an end of the track (8) and then resting the board (4) against the tray (3), a side arm is pivotally connected at one end to one of said support legs (1) under said connection between said tray (3) and support legs (1); and a chair (6) is pivotally connected to another end of said side arm (5).

2. The joint (7) as in claim 1 which is located above and behind said tray (3) to allow the board (4) to rest against the tray (3) to allow for use.

3. A portable, children's all-purpose desk which is comprised of two support legs (1) connected by a tray (3), a top board (4) capable of being reversed from one side to other having a connecting circular point (7) with said legs (1) at a top of said legs (1), said joint (7) allowing said board (4) to be pivoted from one side to other, wherein said joint (7) between said legs (1) and said board (4) comprising a tract (8) along both sides of said board (4) and a bolt protruding from said joint (7), said joint (7) allowing the board (4) to be reversed by sliding said bolt to an end of the track (8) and then resting the board (4) against the tray (3) and wherein said joint (7) is located above and behind said tray (3) to allow the board (4) to rest against the tray (3) to allow for use; a side arm is pivotally connected at one end to one of said support legs (1) under said connection between said tray (3) and support legs (1) and a chair (6) is pivotally connected to another end of said side arm (5), said chair (6) may be folded flush to side arm (5), said side arm (5) then capable of being pivoted to be stored under tray (3) to create a portable desk.

* * * * *